US010322774B2

(12) United States Patent
Willis

(10) Patent No.: US 10,322,774 B2
(45) Date of Patent: Jun. 18, 2019

(54) COLLAPSIBLE KAYAK WITH LARGE COCKPIT

(71) Applicant: Oru Designs, LLC, Oakland, CA (US)

(72) Inventor: Anton Willis, Oakland, CA (US)

(73) Assignee: Oru Designs, LLC, Oakland, CA (US)

( * ) Notice: Subject to any disclaimer, the term of this patent is extended or adjusted under 35 U.S.C. 154(b) by 0 days.

(21) Appl. No.: 15/574,471

(22) PCT Filed: May 16, 2016

(86) PCT No.: PCT/US2016/032669
§ 371 (c)(1),
(2) Date: Nov. 15, 2017

(87) PCT Pub. No.: WO2016/187104
PCT Pub. Date: Nov. 24, 2016

(65) Prior Publication Data

US 2018/0141623 A1 May 24, 2018

Related U.S. Application Data

(60) Provisional application No. 62/162,102, filed on May 15, 2015.

(51) Int. Cl.
*B63B 7/02* (2006.01)
*B63B 35/71* (2006.01)
(Continued)

(52) U.S. Cl.
CPC ..... *B63B 7/02* (2013.01); *B63B 3/48* (2013.01); *B63B 7/06* (2013.01); *B63B 35/71* (2013.01);
(Continued)

(58) Field of Classification Search
CPC .... B63B 7/02; B63B 7/06; B63B 3/48; B63B 35/71
See application file for complete search history.

(56) References Cited

U.S. PATENT DOCUMENTS 5,842,495 A * 12/1998 Egnew ..... E04H 15/38 135/133
6,006,691 A 12/1999 Wilce
(Continued)

FOREIGN PATENT DOCUMENTS

| | | | |
|---|---|---|---|
| DE | 202013008654 | U1 | 11/2013 |
| GB | 479256 | A | 2/1938 |
| KR | 10-1368334 | B1 | 3/2014 |

OTHER PUBLICATIONS

Nov. 21, 2017, International Preliminary Report on Patentability from the International Bureau of WIPO in PCT/US2016/032669, which is an international application of Applicant Oru Kayak, Inc.
(Continued)

*Primary Examiner* — Stephen P Avila
(74) *Attorney, Agent, or Firm* — Kolitch Romano LLP

(57) ABSTRACT

A collapsible watercraft comprised of a single high-strength foldable panel that is creased in a predetermined pattern to form living hinges, the panel being foldable to transform from self-defined compact knocked down package, into a rigid three dimensional kayak form. Other removable rigid structural members, bulkheads, seat assembly and floor-boards help maintain the shape and integrity of the shell.

18 Claims, 9 Drawing Sheets

(51) Int. Cl.

| | |
|---|---|
| ***B63B 7/06*** | (2006.01) |
| ***B63B 3/48*** | (2006.01) |
| *B63B 7/00* | (2006.01) |

(52) U.S. Cl.
CPC ... *B63B 2007/003* (2013.01); *B63B 2007/006* (2013.01)

(56) References Cited

U.S. PATENT DOCUMENTS

| | | | |
|---|---|---|---|
| 6,615,762 | B1 | 9/2003 | Scott |
| 8,316,788 | B2 | 11/2012 | Willis |
| 2011/0017121 | A1 | 7/2011 | Willis |
| 2016/0257378 | A1 | 9/2016 | Jin et al. |

OTHER PUBLICATIONS

Oct. 31, 2016, International Search Report of the International Searching Authority from the U.S. Receiving Office in PCT/US2016/032669, which is the international application to this U.S. application.

Oct. 31, 2016, Written Opinion of the International Searching Authority from the U.S. Receiving Office in PCT/US2016/032669, which is the international application to this U.S. application.

* cited by examiner

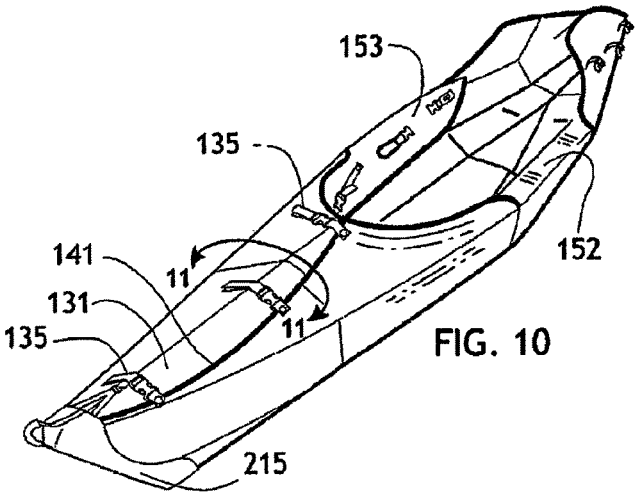
FIG. 10
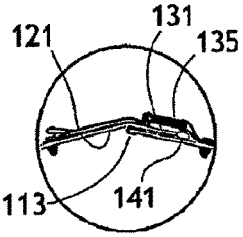
FIG. 11A
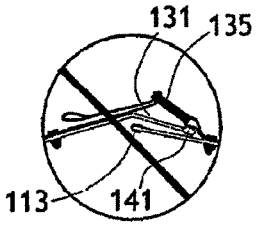
FIG. 11B
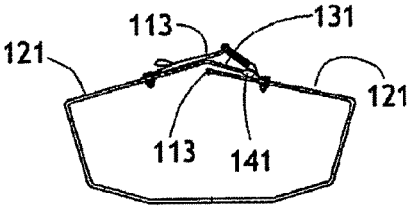
FIG. 12
FIG. 13
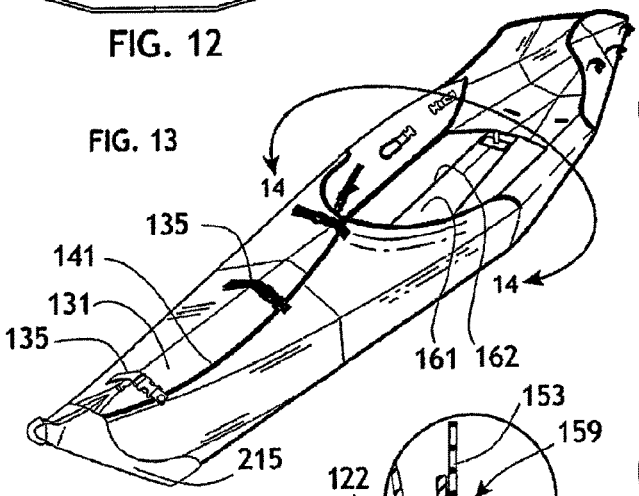
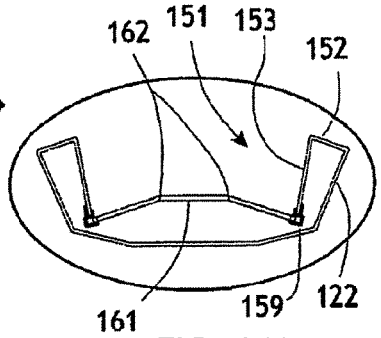
FIG. 14A
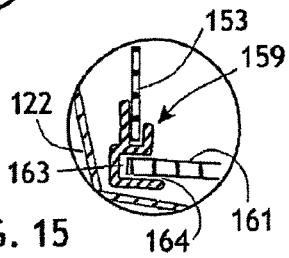
FIG. 15
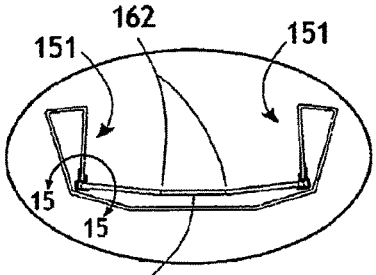
FIG. 14B

COLLAPSIBLE KAYAK WITH LARGE COCKPIT

CROSS-REFERENCE TO RELATED APPLICATIONS

This application is a national phase application of PCT/US2016/032699, filed May 16, 2016, which claims priority to U.S. Provisional Patent Application Ser. No. 62/162,102, filed May 15, 2015, each of which is hereby incorporated by reference.

BACKGROUND OF THE INVENTION

Kayaks, along with canoes and other lightweight, personal watercraft are commonly used for recreational travel on rivers, lakes and oceans. They are also used for fishing and hunting. This invention comprises various improvements that advance the design concepts introduced in U.S. Pat. No. 8,316,788, issued Nov. 27, 2012 to the present inventor, which describes a method and apparatus to build origami-based, folding kayaks out of lightweight corrugated plastic sheet material. A salient advantage of that design is that a single sheet forms the kayak and it may be refolded into a case structure that serves as a self-made container for the watercraft and associated gear when it is in its folded (knockdown) disposition.

Kayaks typically have a rigid rim around the cockpit opening, called a "coaming". This reinforces the structure of the kayak at its weakest point (where a large hole is cut out of the deck, for the user to extend the lower body into and sit inside). Additionally, it provides support for the user when entering and exiting the kayak; normally the user lifts herself out of the kayak with her arms, by placing all of her weight on the coaming. Due to the structural weakness introduced by the cockpit opening, watercraft designers have tended to make this opening as small as is practical and possible for the kayak user. (A small cockpit opening also has the advantage of enabling the use of a waterproof skirt worn about the kayak user and fastened across the opening to prevent water washing into the cockpit.)

The small cockpit opening can interfere with the kayaker enjoying some of the ancillary pleasures associated with watercraft, such as fishing, boating with pets (particularly dogs), and the like. Also, it can be rather confining and limiting for the boater, in terms of bending the legs for positional variety, stretching and flexing the legs, and the like. In addition, below-deck storage is difficult to access, and it is often difficult to access stored gear without landing or docking and exiting the cockpit.

There is of course a tradeoff in providing a spacious cockpit than enables more freedom of movement of the boater, and that is the increased susceptibility to taking on water from waves and rain. Thus a watercraft with a spacious cockpit opening is intended more for calm waters that will not inundate the craft. And the prior art exemplifies a further tradeoff: the decreased stiffness and strength of the midship portion of the watercraft as more spacious cockpit space is designed into the craft.

BRIEF SUMMARY OF THE INVENTION

The present invention is a new type of collapsible kayak (a small paddle-powered watercraft with a covered deck). Using an innovative design system of structural folds in a semi-rigid plastic skin, it achieves unprecedented benefits in terms of performance, weight, portability, ease of assembly, aesthetics and manufacturing cost.

The present invention generally comprises a collapsible kayak construction that is formed of a single sheet of material, and that provides a spacious cockpit area while also providing a stiff midship construction. A fundamental aspect of the invention is the use of a single high-strength foldable panel to fold into the form of a kayak with integrally defined keel, hull, sides, and deck. Using a single folded sheet of high strength, foldable paneling yields the following benefits:

- The form is graceful and made up of continuous curves, for superior performance and aesthetics.
- The strength to weight ratio is outstanding, due to both the monocoque structure, and the specific materials used in the assembly.
- The kayak is fast and offers enhanced performance due to its rigid, smooth skin.
- Assembly in the field is simple and quick, with a minimum of loose parts and complicated joints.

The kayak is fast and offers enhanced performance due to its rigid, smooth skin.

The panel that forms the kayak may be refolded to define its own transport case in its compactly folded configuration. This case holds the disassembled seat and bulkheads, and has sufficient space to contain a paddle and personal flotation device. This eliminates the need for a separate carrying case or bag, further reducing the weight and cost of the system. Thus the folded kayak is extremely portable, with dimensions of approximately 32"×26"×6", and weighing approximately 20 pounds. The materials and manufacturing processes are widely available and commonly utilized and inexpensive, meaning that the invention can be produced at a cost well below that of other kayak types.

The material used may be inexpensively screen-printed as a flat sheet. This allows extensive application of graphics, patterns and logos which are not practical in the manufacture of conventional kayaks.

The key to the present invention is a folded rigid shell formed by a folded, one-piece skin panel, which acts as both waterproof envelope, and primary structure. By means of folding along pre-formed creases, it can be transformed from a compact knocked down package, into a rigid three dimensional erected form which is optimized for performance in the water. Other removable rigid structural members, primarily a seat, seat back, and floorboard help maintain the shape and integrity of the shell.

The preferred material for the folded shell is a twin-walled, extruded polypropylene/polyethylene panel, commonly sold under the trade-names Coroplast™, Cor-X™, Inteplast™, and Solexx™. Its benefits to the present invention include:

- The material's unique ability to form a "living hinge"; that is, to be folded and unfolded along a crease or fold line ad infinitum, without weakening or tearing. These hinges can be created by simply applying mechanical force along any desired crease line; this force crushes the structural corrugations and creates a permanent, reusable folding crease. This is typically accomplished with a steel rule die, which allows all cuts, creases and holes in a sheet to be formed in a single die-stamping operation.
- Superior strength-to-weight ratio, due to the twin-walled extrusion profile.
- Superior toughness and durability.

Positive buoyancy from the air trapped between the twin walled cells of the material, which allows the kayak to float even when completely capsized, for retrieval and rescue.

The kayak construction comprises bow and stern portions and a midship portion extending therebetween. A salient feature of this improved kayak construction is the provision of a spacious cockpit in the midship portion, without sacrificing midship rigidity or strength. The single sheet of corrugated material includes die cut features and longitudinal creases that form permanent hinges in the material. The bow and stern portions include laterally opposed deck flaps that are foldable into overlapping, sealed relationship to define a bow deck and a stern deck, both being impervious to water intrusion.

At the midship portion laterally opposed flaps at the edges of the sheet are foldable downwardly toward the keel portion of the midship, whereby a longitudinally extending beam is formed to add substantial longitudinal beam strength to the midship portion. A floor panel is fitted inside the boat at the midship portion, the floor panel having laterally opposed longitudinal edges that engage the midship flaps and maintain the beam configuration, while at the same time strengthening the midship bottom to support the weight of the boater. A seat post is socketed in a hole in the floor panel to support an adjustably attached seat back. A seat strut extends laterally between the midship beams to support the seat back.

A further improvement of the invention is the provision of a deck hatch to permit access to below-deck storage space without necessitating disassembly of the deck itself. Thus the deck hatch enables access to stored gear and food and water while remaining under way on the water.

BRIEF DESCRIPTION OF THE DRAWINGS

FIG. 10 is a perspective view of the kayak with the bow deck assembled.

FIGS. 11A and 11B are detailed views taken along line 11-11 of FIG. 10, showing the correct and incorrect manner (respectively) of latching the deck panels in overlapping disposition.

FIG. 12 is a lateral cross-sectional elevation of bow section of the kayak.

FIG. 13 is a perspective view of the kayak with the bow deck assembled and the floor panel installed.

FIGS. 14A and 14B are detailed perspective views taken along line 14-14 of FIG. 13, showing the functional relationship of the floor panel and the midship beam structures of the kayak.

FIG. 15 is a detailed view taken along line 15-15 of FIG. 14B.

DETAILED DESCRIPTION OF THE INVENTION

The present invention generally comprises a kayak construction designed to create a lightweight, portable, foldable watercraft. A key feature of the invention is that the kayak is formed of a single panel of high strength, bendable, foldable plastic material. The panel is shaped and creased so that it may be folded and assembled into the kayak form for water transport, and may be refolded and reassembled to form an integral self-storage carrying case for storage and transport. The preferred material for the folded shell is a twin-walled, extruded polypropylene/polyethylene panel, commonly sold under the trade-names Coroplast™, Cor-X™, Inteplast™, and Solexx™. These materials combine high strength, positive buoyancy, ability to form living hinges, and durability, all essential for the purposes of the invention.

Figure 3:
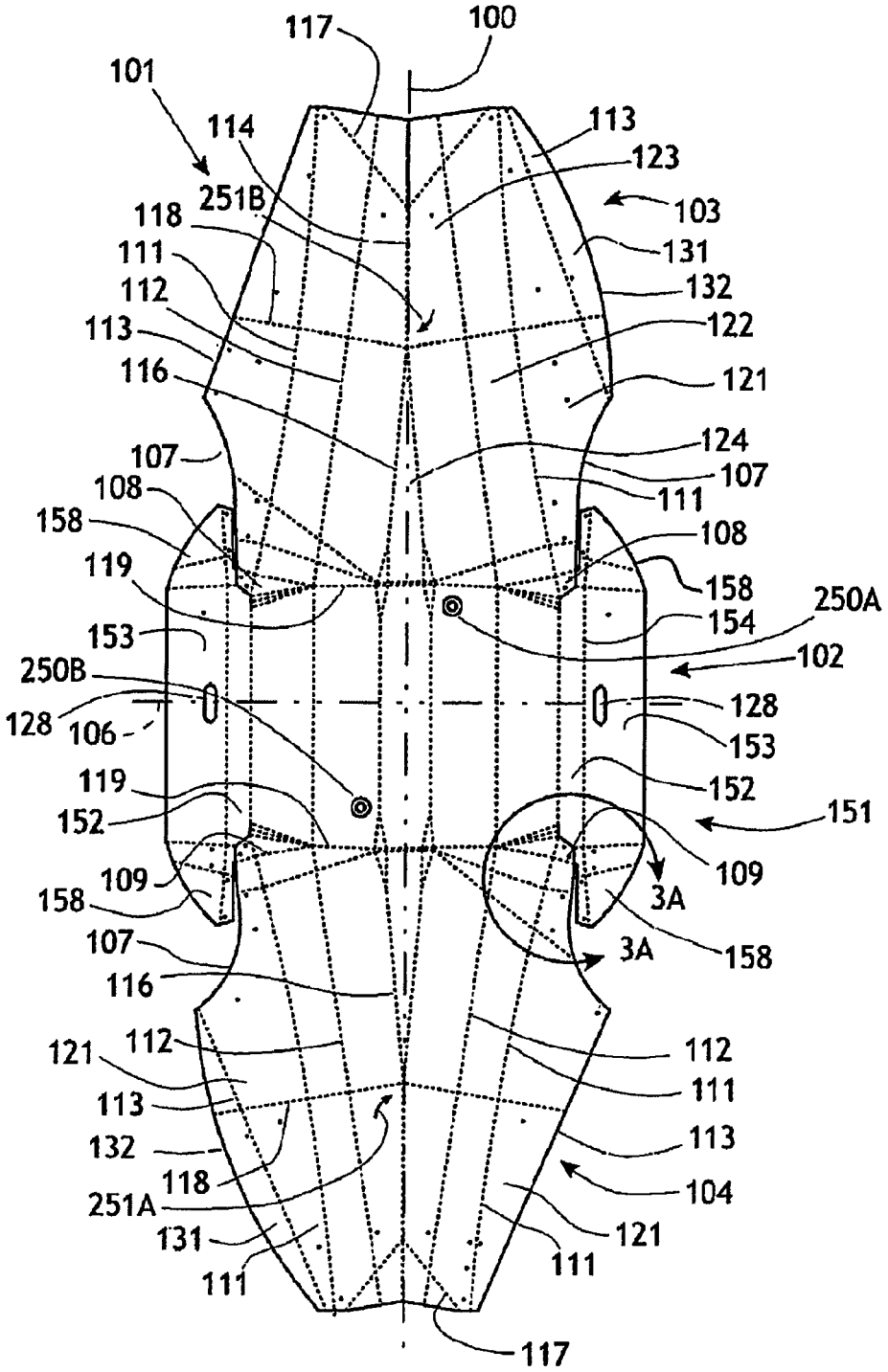
FIG. 3 is a plan view of the creased and cut panel that forms the hull, sides, and deck of the kayak of the invention.

With regard to FIG. 3, the panel 101 that comprises the integral hull, sides, and deck of the kayak is formed of the double-wall material noted above having a large plurality of corrugation ribs extending between the parallel planar walls to define a large plurality of air-filled tubular voids. The panel is provided with a perimeter shape and crease or fold lines that define the axes where the panel will fold when bent by hand to form the configuration of the assembled kayak.

The panel is generally formed with a central (midship) section 102 and end sections 103 and 104 (bow and stern, respectively) extending in opposite directions therefrom. The panel 101 is generally symmetrical (enantiomorphic) with respect to a longitudinal axis 100, and the ends 103 and 104 are substantially symmetrical about a lateral-medial axis 106. The end sections 103 and 104 are generally described as truncated conical shapes (when assembled), and the central section is a rectangle with laterally opposed side edges 107 that are concave, scalloped shapes to define the perimeter of the cockpit 105 at the bow and stern ends, as will be described below. In addition, a pair of darts 108 (in the manner of tapered tucks provided in fabric constructions and garments) are disposed between the central section 102 and the end section 103, the darts flaring laterally outwardly in laterally opposed fashion. Likewise, another pair of darts 109 extend between the central section and the end section 104 in symmetrical relationship to the first pair.

A plurality of permanent fold lines extend longitudinally the length of the panel 101 and define the hull, sides, and deck of the assembled kayak. Each side of the panel is provided with fold lines 111 and 112 that extend in generally parallel, spaced apart relationship and are aligned intermediate of the longitudinal axis 100 and the tapered edge 113 of section 103. Fold line 111 is curved to define the boat-like curvature of the hull and deck forms, and distinguishes this kayak from other "boxy" rigid folding boats. Each side also includes a longitudinal fold line 114 extending along the longitudinal axis from each end toward the central section 102, and it bifurcates to define fold lines 116 that extend generally parallel to fold lines 111 and 112.

Figure 1:
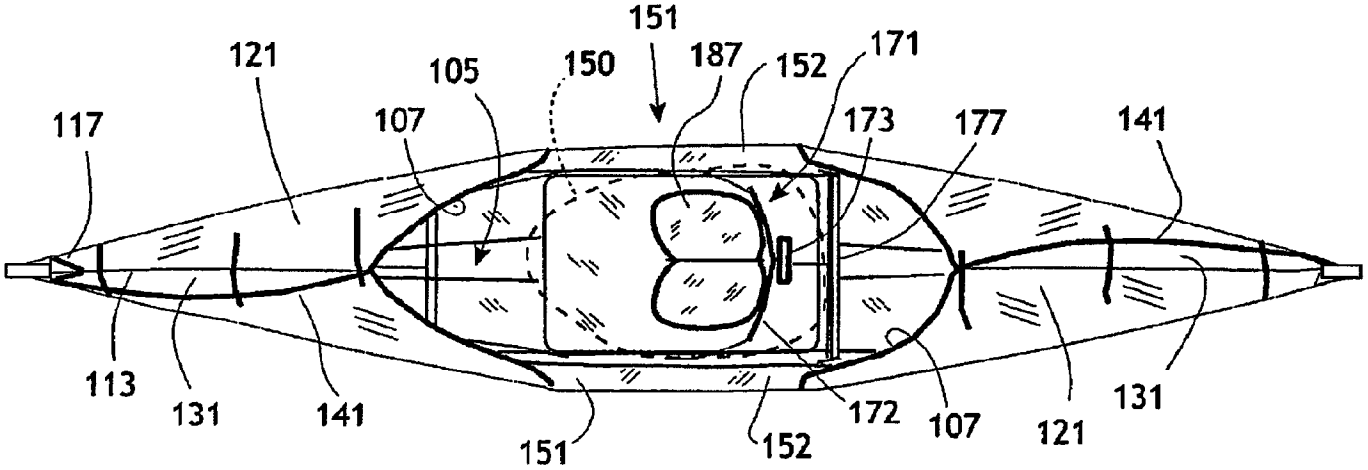
FIG. 1 is a plan view of the kayak of the present invention, shown in the fully assembled condition.
Figure 2:
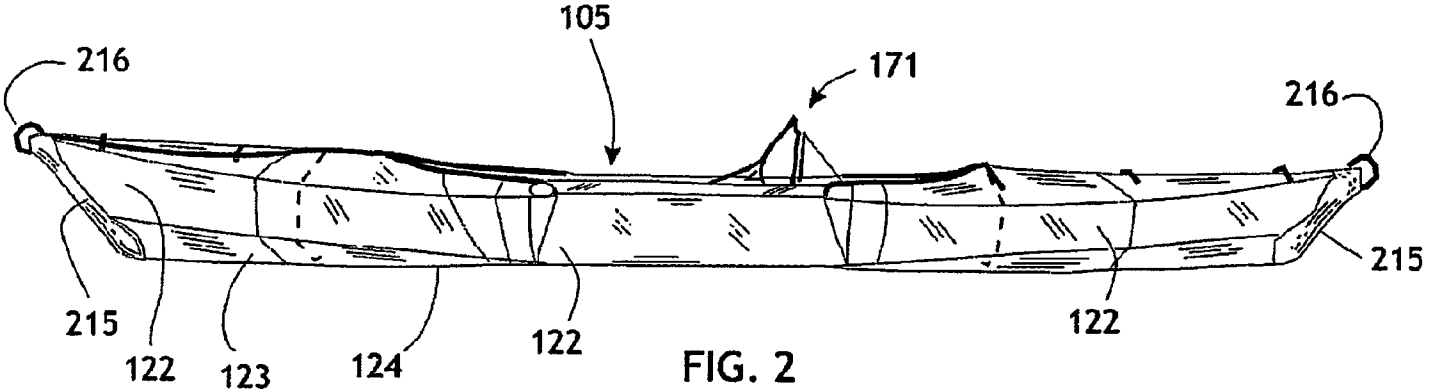
FIG. 2 is a side elevation of the kayak as shown in FIG. 1.

With additional reference to FIGS. 1 and 2, in general the panel portion between outer edge 113 and fold line 111 comprises a portion of the deck 121 of the kayak, the panel portion between lines 111 and 112 forms the side (freeboard) 122 of the kayak, the panel portion between lines 112 and 116 defines the hull 123 of the kayak, and the panel portion between opposed lines 116 comprises the keel 124 of the watercraft. In addition, a V-shaped fold line 117 extends into each end of the panel to define a folded-in dart, as will be described below.

In addition to the longitudinal fold lines and the darts 108, 109, the panel 101 is also provided with transverse fold lines that enable the panel to be folded into a compact storage configuration in which it forms its own case for carrying and transport. A pair of fold lines 119 are provided at opposite ends of the central section 102, demarcating the boundaries with the end sections 103 and 104 and each defining one edge of each of the darts 108 and 109. A pair of fold lines 118 extend in the end sections 103 and 104, each fold line oriented generally transverse to the adjacent outer edge 113 and intersecting the longitudinal axis 100. These fold lines 118 and 119 enable the panel 101 to be folded so that the ends may be brought together in accordion fashion to form a compact knocked down configuration, as described in detail below. It may be appreciated that when the panel is folded into the kayak configuration with longitudinally extending vertices, those vertices transect the lateral fold lines and prevent bending movement along the lateral fold lines.

The general plan layout and fold lines described above are generally similar to the kayak plan layout detailed in U.S. Pat. No. 8,316,788, referenced above. The new features described below are added to provide a spacious cockpit without sacrificing the strength or stability of the watercraft, to further simplify assembling the kayak and disassembling it and folding it into a self-defined carrying case, and to provide easy access to below-deck storage space without necessitating opening the deck panel assembly.

One salient new feature of the kayak is the manner in which the deck panels 121 are joined to form the kayak deck without requiring alignment and engagement of the two confronting edges 113 of the bow and stern deck panels 121. Rather, as shown with continued reference to FIGS. 1-3, the sheet 101 includes a pair of deck flaps 131, each integrally formed at a crease extending along edge 113 and extending hingedly therefrom with a broadly curved outer perimeter 132. At the bow end the deck flap 131 extends from the starboard edge 113, and at the stern end the deck flap 131 extends from the port edge 113, but this alternating arrangement is not a necessary part of the invention. As shown in FIG. 12, the two bow (or stern) deck panels are brought together so that the two edges 113 are proximate and the deck flap 131 overlaps the adjacent deck panel. Ratchet buckle mechanisms 135 are disposed adjacent to the edges 113 and are positioned to extend over the overlapping deck flap 131 to the respective opposed deck panel ratchet tongue and releasably secure the deck flap 131 over the deck panel 121, as shown in FIG. 11A. Secured along the entire perimeter 132 is an edge fitting 141, comprising a strip of resilient material that has a channel-like recess to receive the die cut edge of the sheet material 101. The edge fitting 141 is compressed into the outer surface of the deck panel 121 when the ratchet mechanisms are tightened, forming a seal that rejects substantially all water intrusion. In addition, the overlapping deck flap 131 and deck panel 121 thereunder are joined in surface-to-surface engagement along the substantial length of the flap 131, resulting in enhanced stiffness of the deck assembly and thus the bow assembly in general.

Joining the deck panels fore and aft in this manner eliminates the need to bring the opposed edges (and any intervening channel fitting) into rather precise alignment in order for them to be united together to close the deck assembly. Merely by latching the ratchet mechanisms together and tightening them down, the deck panels may be assembled without any intricate alignment.

Another salient feature of the invention is the provision of an enlarged cockpit for the kayak user, encompassing a substantial portion of the midship area of the kayak. With reference to FIG. 1, a typical kayak cockpit opening may be as small as the outline 150, which may require the kayak user to undergo some difficult maneuvers to slide the legs forward into the cockpit opening. In contrast, the cockpit of the invention is defined fore and aft by the edge portions 107, which are spaced apart much greater than the typical cockpit opening. (The edge portions 107 may be provided with the edge fitting 141 as a continuation of the strip that also covers adjacent edge 132, as shown in FIG. 1.)

Figure 3A:
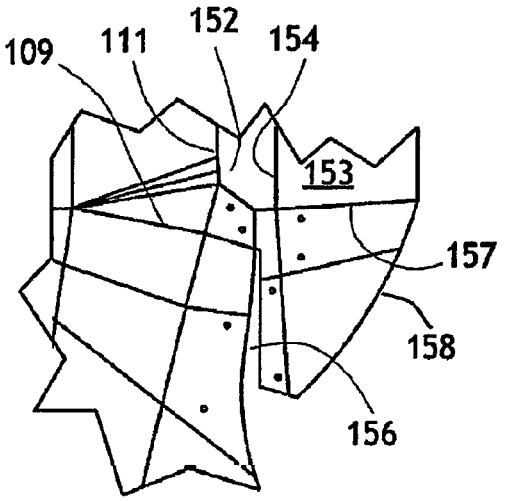
FIG. 3A is a detailed view taken along line 3A-3A of FIG. 3.
Figure 6:
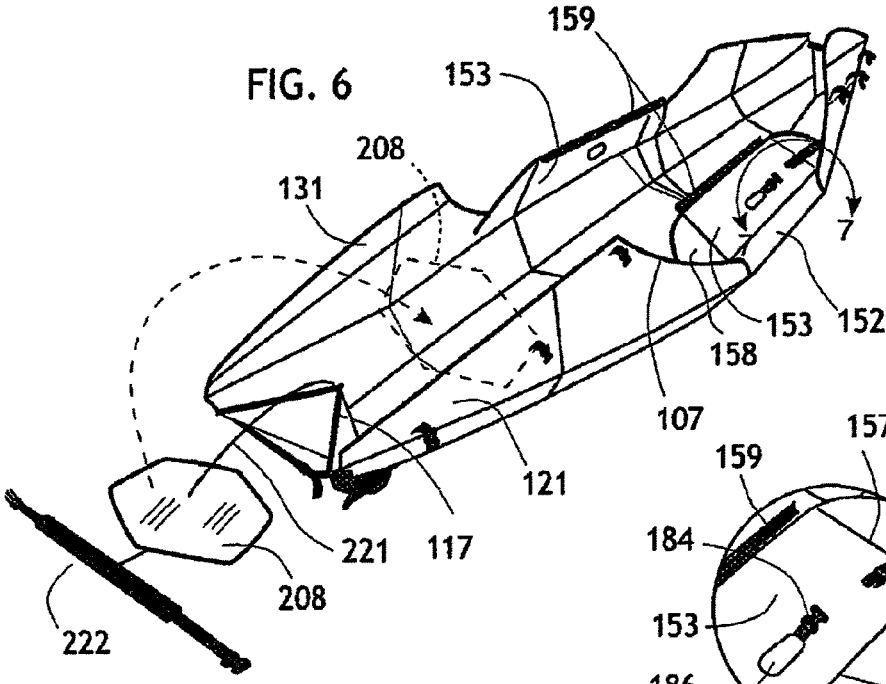

The sides of the cockpit 105 are defined by a pair of gunwale assemblies 151 extending longitudinally, as shown in FIG. 1. The term gunwale is defined herein with the traditional usage as the widened edge at the top of the side of a canoe-like boat. Each gunwale assembly 151 is formed by a combination of panels formed at the midship area. With reference to FIGS. 3 and 3A, a rectangular flap 152 extends laterally outwardly from the centerline along fold line 111 between darts 108 and 109, and is integrally and hingedly joined to the sheet 101 along line 111. Rectangular flap 153 is hinged to flap 152 along fold line 154 that is generally parallel to adjacent line 111. Gore cuts 156 extend longitudinally into the edge of the sheet adjacent to edge portions 107, freeing flap 153 to rotate about hinge 154. In addition, fold lines 157 extend transversely to fold line 154 to define distal tabs 158 that are hinged at either end of flap 153 and secured below-deck, as described below. As shown also in FIGS. 6 and 7, a channel-like edge fitting 159 is secured to the outer longitudinal edge of flap 153.

With regard to FIGS. 1, 13, 14A, 14B and 15, a rigid floorboard 161 is also provided, comprising a rectangular piece of a material similar to panel 101. The floorboard is shaped to be complementary to the underlying portion of the bottom of the kayak in the cockpit area, and is provided with longitudinal parallel fold lines 162. The floorboard is placed against the bottom of the kayak, in the central section of the panel that forms the cockpit, and is provided to help maintain the shape of the kayak's bottom against water pressure and internal stresses in the skin. It also protects the skin by evenly distributing the weight of the occupant, and help to keep the cross-rib aligned perpendicular to the keel.

Moreover, with reference to FIG. 15, the floorboard 161 has laterally opposed, longitudinally extending side edges 163 that are insertable into a slot opening 164 of the edge fitting 159. The floorboard 161 may be maneuvered so that the edges 163 are engaged in the slots 164, as shown in FIGS. 14A and 15. Note that the floorboard 161 is bowed upwardly and flexed along longitudinal fold lines 162. Upon placing a load on the floorboard (e.g., the weight of the kayaker), its bowed curvature is flattened and slightly inverted, as shown in FIG. 14B, causing the edge fitting 159 to be driven outwardly toward the side panel 122. The reverse flexure of the floorboard acts like an over-center spring to retain the fitting 159 against the side panel 122, and the assembly of panel 122 and flaps 152 and 153 forms a structural beam having a rigid outer skin and a substantial beam bending moment. The twin structural beams of the gunwale assemblies 151 provide exceptional rigidity and strength in connecting the fore and aft assemblies at the midship section, due to the large, triangular cross-sectional area of the assembled beam which exhibits a very large bending moment. Thus the construction enables the spacious cockpit layout of the kayak without sacrificing the structural integrity of the assembled watercraft.

Figure 16:
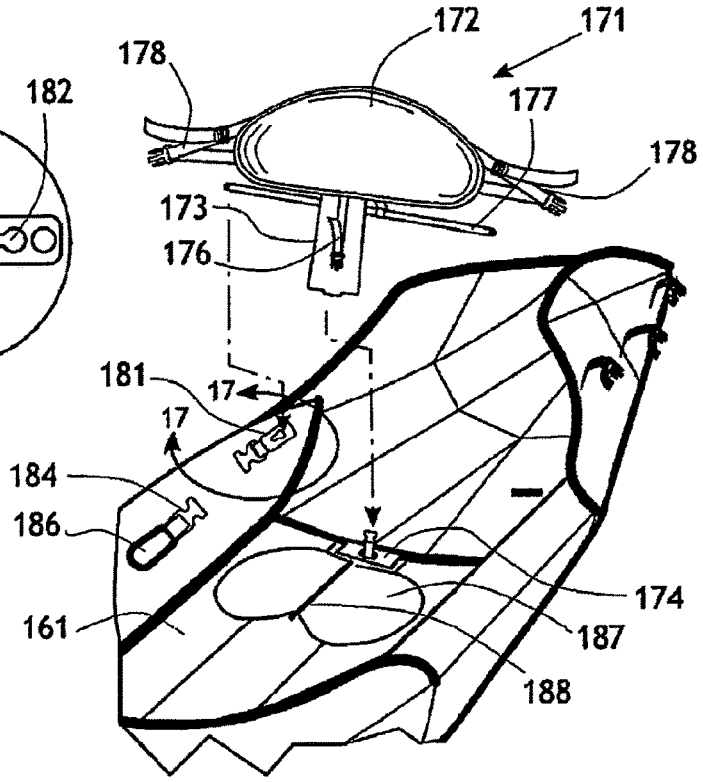
FIG. 16 is an enlarged perspective view of the midship and stern portions of the kayak, showing the installation of the seat components therein.
Figure 18:
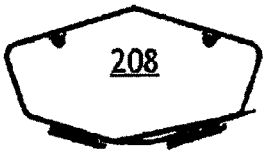
FIG. 18 is a plan view of the stern bulkhead of the kayak.
Figure 19:
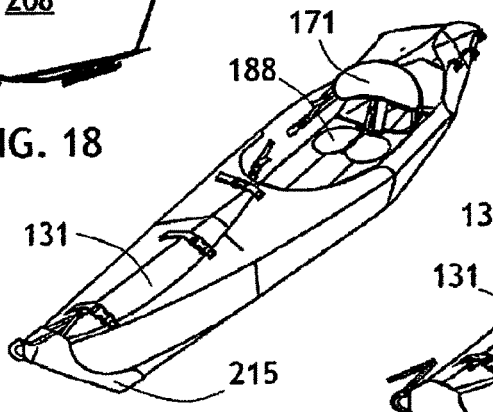
FIG. 19 is a perspective view of the kayak, showing the seat and stern bulkhead installed.

The cockpit 105 also includes a seat back assembly 171, shown particularly in FIG. 16. A backrest 172 is supported by a seat column 173 that is secured at its lower end in a receptacle 174 that is formed and reinforced adjacent the aft edge of the floorboard 161. A strap 176 depending from the backrest 172 is releasably secured to a buckle extending from the floorboard 161. In addition, a pair of straps 178 with buckle ends extend laterally outwardly from opposed sides of the backrest 172.

Figure 17:
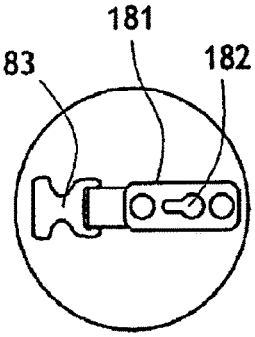
FIG. 17 is a detailed view taken along line 17-17 of FIG. 16.

Each flap 158 at the stern end is provided with a mounting plate 181 having a keyhole opening 182 therein and a strap buckle 183 extending from one end thereof, as shown in FIG. 17. A seat strut 177 extends laterally just below and aft of the backrest 172. The keyhole openings 182 are positioned, when the gunwale assemblies 151 are formed, to receive the opposed ends of the seat strut 177, as shown in FIG. 16. The ends of strut 177 are placed in the large end of the keyhole opening 182, slidably moved forward into the narrow end, and held therein. The strut 177 joins the two gunwale assemblies 151 rigidly and not only provides support under tension for the upper end of the seat column 173, but also couples together the gunwale assemblies 151 for lateral compression strength of the hull in the midship section. The backrest is held in place by engaging the buckle 183 with straps 178 of the backrest 172 and a portion of straps 178 connect to a buckle 184 extending from a reinforced handhold opening 186 formed in panel 153. The cockpit is completed by the addition of a seat pad 187 removably secured to the floorboard 161 by an elastic cord 188.

Figure 30:
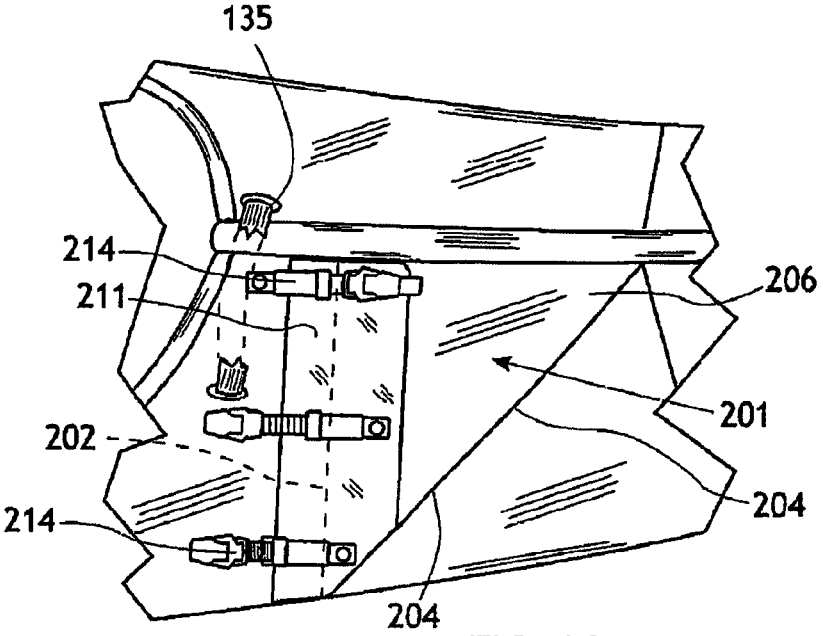
FIG. 30 is an enlarged top perspective view of the deck hatch construction of the kayak invention, in the closed disposition.
Figure 31:
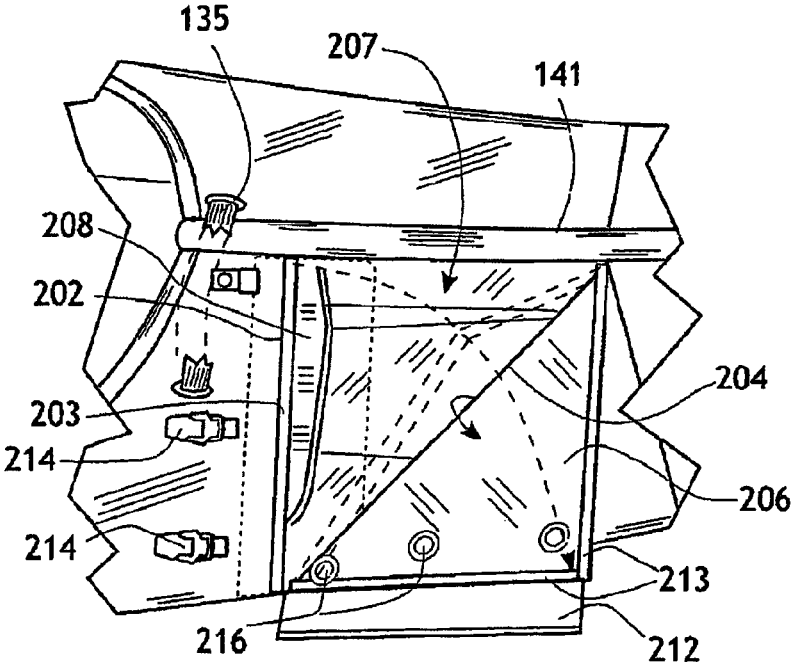
FIG. 31 is a similar view showing the hatch in the open position.

A further improvement of the invention is the provision of a deck hatch 201 to permit access to below-deck storage space without necessitating disassembly of the deck itself. With regard to FIGS. 30 and 31, the hatch 201 is formed by placing a linear cut 202 in the sheet 101 extending in the deck panel 121 from a stern edge 113 (having no flap 131), the cut 202 extending generally transversely to the edge 113 and adjacent to the intersection of the curved edge 107. A narrow channel edge seal 203 is secured to the forward edge of the cut 202. In addition, a fold line 204 is formed in the deck panel 121, extending obliquely rearwardly from the outer terminus of cut 202 and intersecting the edge 113 to define a triangle flap 206. As shown in FIG. 31, the triangle flap 206 may rotate about the fold line 204 to define a triangular opening 207 that enables access to the below-deck space in the aft deck assembly. Note that the cut 202 is placed aft of the rear bulkhead 208 (described in more detail below), and that the below-deck space would otherwise be inaccessible except by disassembling the stern deck panels.

Joined to the outer surface of the segment 206 is a flange plate 211, comprising a panel of stiff polymer material that overlaps the edge of the flap 206 at flange 212. Edge sealing strips 213 are applied to the free edges of flap 206 to impinge on the seal strip 203 and the edge fitting 141 and prevent water intrusion. A plurality of ratchet strap mechanisms 214 are secured adjacent to cut 202, each having respective flap ends secured therein by posts or bolts 216. The opposed ends are secured in the deck panel 121 adjacent to forward edge of the cut 202. The bolts 216 serve to secure the ratchet strap ends to the flap 206 and also secure the reinforcing flange plate 211 to the flap. The flange 212 overlays the opening when the flap 206 is in the closed position of FIG. 30, protecting it from water and strengthening the deck assembly at the opening. The ratchet strap mechanisms 214, when closed, compress the flange plate 211 into the seal 203 and hold the flap 206 rigidly in place.

Thus it is possible to gain access to the below-deck space aft of the bulkhead without opening the deck panels assembly, a task that should be accomplished when docked or otherwise not afloat. Thus the deck hatch 201 is a great convenience in allowing access to gear, food, water, clothing, and the like stored in the kayak, while remaining afloat and in action on the water. It should be noted that the deck hatch 201 does not interfere nor interact with the reconfiguration of the sheet 101 from kayak to integral box forms.

The kayak also includes a pair of fairings 215 (bow and stern), shown in FIGS. 2, 10, 13, 18 and 19, comprised of a channel-like flexible boot that is complementary in size and form to the leading edge and trailing edge of the bow and stern of the assembled kayak. The fairings joined to the bow and stern cushion the impact of direct collisions of the bow or stern with objects, and also serve to limit water intrusion into the folded bow and stern assemblies. Each fairing 215 includes a loop 216 at the upper outer end thereof to facilitate lifting the end of the kayak using a simple finger grip.

Figure 4:
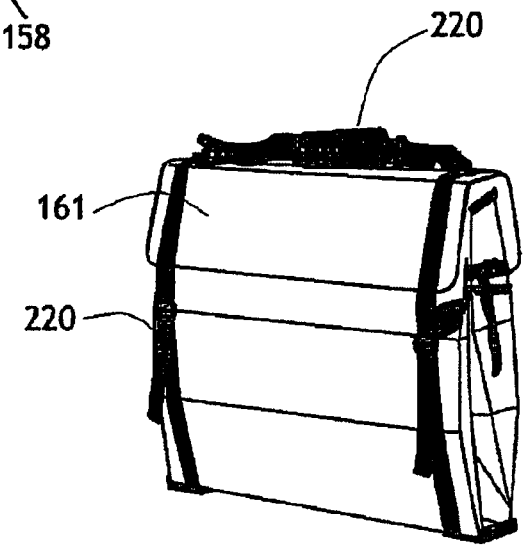
FIG. 4 is a perspective view of the kayak of the invention, disassembled and refolded into a self-defined carrying case.
Figure 5:
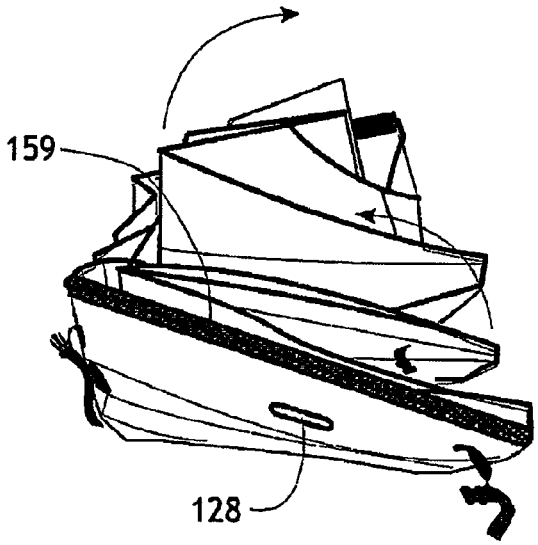
FIGS. 5 and 6 are sequential perspective views showing the first steps in folding the panel of FIG. 5 to form the assembled kayak.

To set up the kayak, the user follows these steps:

1. Assuming that the kayak is in its self-define box configuration of FIG. 4, the carrying strap harness 220 is removed, and the floorboard 161, which also forms the top of the box is removed. Coupling straps that hold the opposed sides of the box together are released, and the kayak begins to unfold and open, as shown in FIG. 5. The folded ends within the box are rotated outwardly and upwardly, as indicated by the arrows in FIG. 5. The unfolded sheet, shown in FIG. 6, reveals a bow bulkhead 208 secured to the bow end of sheet 101 by a tension line 221 joined at the centerline 100. At the distal end of the line 221 it is secured to the midpoint of a footrest 222, which is a bar or strut having strap/buckle fasteners at both ends.
2. The flaps 153 are folded inwardly into the cockpit area. The bow bulkhead 208 is placed into the forward hull area, as shown in broken line in FIG. 6, and the footrest 222 is also placed laterally astern of the bulkhead 208. The footrest straps are clipped in place to adjustable buckles secured within the hull (not shown). The bow bulkhead is secured in place by fittings secured to the interior hull surface.
3. Bow and stern creases 117 are folded longitudinally inwardly in accordion fashion (FIG. 6) to form an upswept leading bow edge, and secured in place with adjustable buckle assemblies. Resilient weatherstripping may be secured to the mating surfaces of the bow and stern creases 117 in order to exclude water intrusion.

Figure 7:
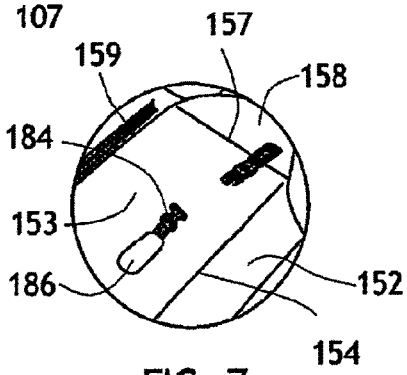
FIG. 7 is a detailed view taken about line 7-7 of FIG. 6.
Figure 8:
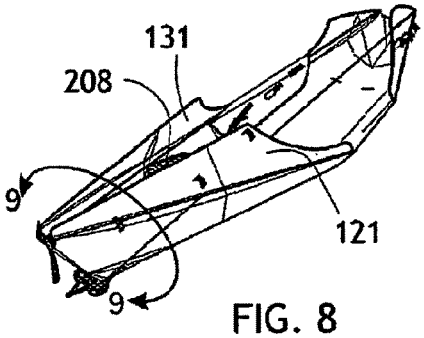
FIG. 8 is a perspective view of the assembly of the bow deck portion of the kayak.
Figure 9:
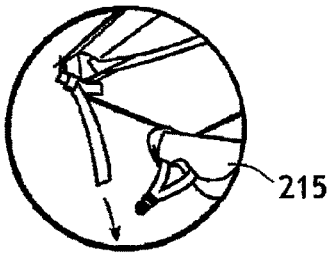
FIG. 9 is a detailed view of the bow assembly of the kayak, taken along line 9-9 of FIG. 8.
Figure 20:
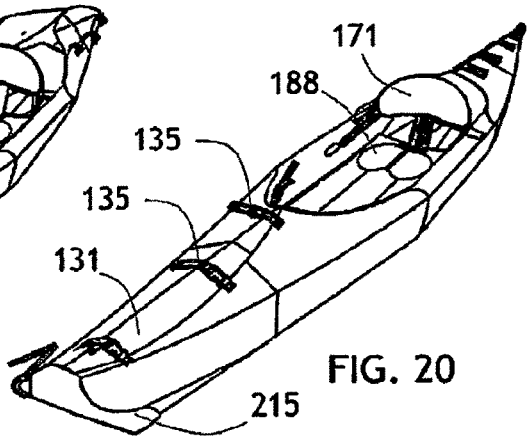
FIG. 20 is a perspective view of the kayak, showing the seat and stern bulkhead installed and the stern deck flaps closed and latched.

4. The opposed edges 113 are rolled inwardly toward each other, as shown in FIG. 7, with the flap 131 overlapping the edge 113 of the opposed deck panel 121, as shown in FIG. 8. Starting with the middle unit, the adjustable buckle assemblies 135 are joined and tightened to secure the deck assembly (FIGS. 11A and 11B). The fairing 215 is then stretched over the bow and secured with a deck strap and tightened (FIG. 9), so that the assembly is in the disposition of FIG. 10.
5. The floorboard 161 is then placed in the bottom of the cockpit area formed by the central section 102, with its fold lines extending longitudinally and curved convexly upwardly, as shown in FIGS. 13, 14A and 14B. The edges 163 of the floorboard 161 are placed into the channels 164 of the edge fittings 159 of the flaps 153 (FIG. 15) and the floorboard 161 is pushed downwardly to the concave disposition of FIG. 14B. This position assures that the flaps 152 and 153 form the triangular beam assemblies and remain securely in the assembled gunwale configurations.
6. With regard to FIG. 16, the seat assembly is then installed. The seat pad 187 is installed under elastic cord 188, and the lower end of seat column 173 is inserted into socket 174 in the floorboard 161. The strap 176 is secured with a buckle extending from the floorboard to the seat column. The seat strut 177 is then installed in the keyhole openings 181 of the flaps 158, and the straps 178 are connected to buckles 184 of flaps 153, which are adjacent to reinforced handhold opening 186, resulting in the disposition of FIG. 19.
7. The stern end is then assembled by joining fold 117 as described for the bow end. The stern bulkhead 208 (FIG. 18), which is substantially the same as the bow bulkhead, is then placed into the stern section and secured in a similar manner. The stern deck flaps are then overlapped and secured with ratchet strap assemblies 135, as shown in FIG. 20, and the assembly is complete.

Figure 21:
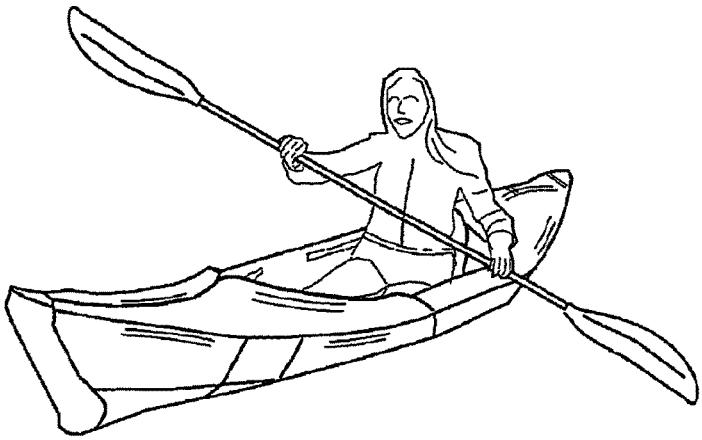
FIG. 21 is a perspective view of the kayak fully assembled and occupied by a kayaker.

After adjusting the positions of the seat back height on the seat column, and the distance of the footrest from the seat back, the kayak is ready to launch and to be enjoyed on the water, as shown in FIG. 21.

Figure 22:
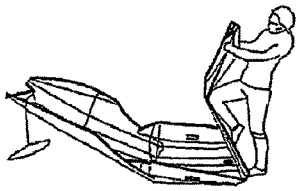
FIGS. 22-29 are a sequence of perspective views depicting the folding of the kayak into a compact case configuration for transport and storage.
Figure 23:
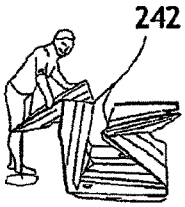

To disassemble the kayak, the steps 106 above are generally reversed. The adjustable buckles 135 are released, bow and stern folds 117 are released, the seat assembly is removed, and the floorboard 161 is removed. The panel 101 may then be folded into a configuration in which it forms its own integral case for self-storage of the panel 101 and the ancillary components). The panel is placed in a flattened disposition as shown in FIG. 3 and, as shown in FIG. 16, the opposed end sections 103 and 104 are folded upwardly in turn along fold lines 119. Each of the end sections 103 and 104 are folded inwardly each toward the other along fold lines 118, forming converging vertices 242. Note that the user may stand at the end of the sheet, grasp the end of the sheet and use the knee maneuver of FIG. 22 to force the inward fold along line 118. The converging end sections 103 and 104 tend to draw together the opposed sides 102*a* and 102*b* of central portion 102, so that the opposed sides rotate each toward the other about fold lines 116.

Figure 24:
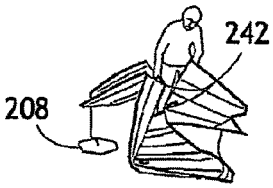

With regard to FIG. 24, the confronting vertices 242 are diverted slightly laterally as they are brought into approximation, and the end sections 103 and 104 begin to fold about lines 116 as the side portions 102*a* and 102*b* continue to rotate toward each other. In this regard, the invention provides indicia on the sheet 101 that aid in aligning the converging sections properly. As shown in FIG. 3, a pair of target indicia, such as the bullseyes 250, are formed on the interior surface of sheet 101, each adjacent to an intersection of fold lines 116 and 119. A complementary pair of arrows 252 are also provided, each disposed at an intersection of fold lines 114 and 118. Each bullseye and arrow pair, 250A and 251A, and 250A and 250B, may be color coded to make apparent their intended proximity.

Figure 25:
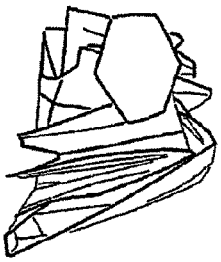
Figure 26:
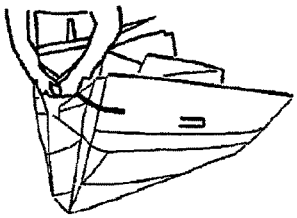
Figure 27:
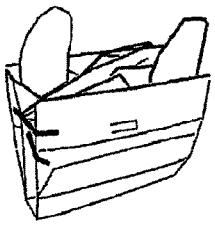
Figure 28:
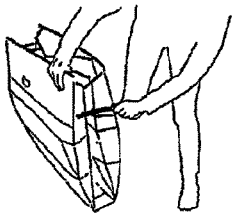
Figure 29:
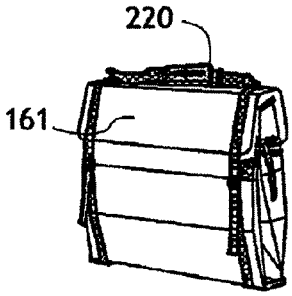

As a result, the folding end sections 103 and 104 slide past each other as they collapse together, with the end section 104 folded substantially flat along axis 114 and impinging on the inner surface of the side of the central section 102. In a like manner, the end section 103 is folded substantially flat and impinging on the inner surface of the side portion of central section 102 (FIG. 25), thus defining the carrying case of FIG. 19. The opposed sides of the now-defined box configuration (FIG. 26) are joined together with strap assemblies provided for that purpose. The interstitial spaces between the folded panels within the case may be used as storage to store the bow and stern bulkheads, seat pad, paddles, and other ancillary gear (FIG. 27), without affecting the ability of the box configuration to be closed and latched (FIG. 28). The footboard 161 is placed over the open top of the carrying case, folded along its longitudinal fold lines 162, and secured thereto with the strap harness 220 to define an integrally formed, self-storage case for the kayak and its components (FIG. 29). The case may be furnished with additional straps or handles for carrying by hand, or as a backpack.

Custom extrusions of the preferred twin-walled plastic skin material may be used to enhance the performance and durability of the kayak. For instance, the outer surface of a custom sheet could be made thicker than the inner surface, in order to better resist abrasion and impacts from rocks, snags, sandbars, and other obstacles.

The same methods and materials may be applied to other portable, collapsible watercraft such as canoes, rowboats, dinghies, sailboats and the like. Likewise, they may also be applied to folding furniture, packaging, and portable structures.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The present disclosure may include one or more of the following concepts:

A. In a collapsible watercraft formed of a stiff sheet that is creased and foldable along fold lines that define the keel, hull, sides and deck of a kayak configuration, with opposed side edges of the sheet that are folded inwardly each toward the other about a longitudinal axis and brought together to form the kayak configuration, the improvement comprising:

said sheet including a pair of bow edges extending at opposed sides of the bow end of the panel and tapering toward the bow end, said pair of bow edges being brought into close proximity to form the bow deck assembly of said kayak configuration;

a bow deck flap hingedly secured to one of said bow edges at one of said opposed sides and dimensioned and configured to overlap the other of said opposed sides of said bow edges and form a closure therewith when formed into said bow deck assembly;

at least one strap fastener assembly extending between said opposed bow edges in releasable, length-adjustable fashion to secure said bow deck flap in overlapping impingement to said other side and join and secure said bow deck assembly.

B. The improved collapsible watercraft in accordance with paragraph A, wherein said bow deck flap extends substantially the entire length of said other opposed side of said bow edges to form a sealed bow deck closure therewith.

C. The improved collapsible watercraft in accordance with paragraph A, wherein said sheet including a pair of stern edges extending at opposed sides of the stern end of the panel and tapering toward the stern end, said pair of stern edges being brought into close proximity to form the stern deck assembly of said kayak configuration;

a stern deck flap hingedly secured to one of said stern edges at one of said opposed sides and dimensioned and configured to overlap the other of said opposed sides of said stern edges and form a closure therewith when formed into said stern deck assembly;

at least one strap fastener assembly extending between said opposed stern edges in releasable, length-adjustable fashion to secure said stern deck flap in overlapping impingement to said other side and join and secure said stern deck assembly.

D. The improved collapsible watercraft in accordance with paragraph C, wherein said stern deck flap extends substantially the entire length of said other opposed side of said stern edges to form a sealed stern deck closure therewith.

E. The improved collapsible watercraft in accordance with paragraph C, further including a pair of gunwale assemblies extending longitudinally between said bow deck assembly and said stern deck assembly, each gunwale assembly comprising a hollow tubular beam extending along a respective side of the kayak configuration.

F. The improved collapsible watercraft in accordance with paragraph E, wherein each of said gunwale assemblies includes a side panel defined by said fold lines in a midship portion of said sheet, a first gunwale flap hingedly secured to said side panel in integral fashion along a first gunwale fold line, and a second gunwale flap hingedly secured to said first gunwale flap in integral fashion along a second gunwale fold line.

G. The improved collapsible watercraft in accordance with paragraph F, wherein said first and second gunwale fold lines extend generally longitudinally.

H. The improved collapsible watercraft in accordance with paragraph F, wherein said first and second gunwale fold lines are generally parallel.

I. The improved collapsible watercraft in accordance with paragraph F, wherein said first and second gunwale flaps are foldable along said gunwale fold lines to form a triangular tubular relationship with said side panel and define said hollow tubular beam.

J. The improved collapsible watercraft in accordance with paragraph I, further including a floorboard adapted to be secured in said midship portion of the kayak.

K. The improved collapsible watercraft in accordance with paragraph J, wherein each of said second gunwale flaps include a longitudinally extending free edge, and an edge fitting secured to said longitudinally extending free edge and adapted to engage a longitudinal edge portion of said floorboard.

L. The improved collapsible watercraft in accordance with paragraph K, wherein said floorboard has sufficient lateral width to urge said longitudinally extending free edges of said second flaps to diverge laterally outwardly and maintain said triangular relationship of said hollow tubular beam.

M. In a collapsible watercraft formed of a stiff sheet that is creased and foldable along fold lines that define the keel, hull, sides and deck of a kayak configuration, with opposed side edges of the sheet that are folded inwardly each toward the other about a longitudinal axis and brought together to form the kayak configuration, the improvement comprising:

a deck panel defined by said fold lines and having a free edge extending longitudinally;

a deck hatch formed in said deck panel and movable between a closed disposition and an open disposition that enables access through the deck hatch to a below-deck storage space.

N. The improved collapsible watercraft in accordance with paragraph M, wherein said deck hatch includes a cut line extending in said deck panel from said free edge toward an adjacent side of said kayak, and a hatch fold line extending from the terminus of said cut line obliquely to said free edge to define a triangular hatch flap hingedly secured at said hatch fold line and rotatable between said open and closed dispositions.

O. The improved collapsible watercraft in accordance with paragraph N, further including a flange plate secured to said triangular hatch flap and disposed to overlap said cut line when said hatch flap is in the closed disposition.

P. The improved collapsible watercraft in accordance with paragraph O, further including adjustable length strap assemblies extending across said cut line and including first portions joined to said hatch flap and second portions joined to said deck panel adjacent to said cut line to releasably secure said deck flap in the closed disposition with said flange plate impinging on said deck panel and overlapping said cut line.

Q. The improved collapsible watercraft in accordance with paragraph N, wherein said sheet further includes a pair of bow edges extending at opposed sides of the bow end of the panel and tapering toward the bow end, said pair of bow edges being brought into close proximity to form the bow deck assembly of said kayak configuration;

a bow deck flap hingedly secured to one of said bow edges at one of said opposed sides and dimensioned and configured to overlap the other of said opposed sides of said bow edges and form a closure therewith when formed into said bow deck assembly;

at least one strap fastener assembly extending between said opposed bow edges in releasable, length-adjustable fashion to secure said bow deck flap in overlapping impingement to said other side and join and secure said bow deck assembly.

R. The improved collapsible watercraft in accordance with paragraph C, further including a pair of gunwale assemblies extending longitudinally between said bow deck assembly and a stern deck assembly, each gunwale assembly comprising a hollow tubular beam extending along a respective side of the kayak configuration.

S. The improved collapsible watercraft in accordance with paragraph K, wherein said sheet further includes a plurality of lateral folds to enable said sheet further to be refolded and configured as a self-defined carrying case.

T. The improved collapsible watercraft in accordance with paragraph S, wherein said floorboard is configured to be folded to form a top for said self-defined carrying case.

The invention claimed is:

1. In a collapsible watercraft formed of a stiff sheet that is creased and foldable along fold lines that define the keel, hull, sides and deck of a kayak configuration, with opposed side edges of the sheet that are folded inwardly each toward the other about a longitudinal axis and brought together to form the kayak configuration, the improvement comprising:

a deck panel defined by said fold lines and having a free edge extending longitudinally; and a deck hatch formed in said deck panel and movable between a closed disposition and an open disposition that enables access through the deck hatch to a below-deck storage space;

wherein said deck hatch includes a cut line extending in said deck panel from said free edge toward an adjacent side of said kayak, and a hatch fold line extending from the terminus of said cut line obliquely to said free edge to define a triangular hatch flap hingedly secured at said hatch fold line and rotatable between said open and closed dispositions.

2. The improved collapsible watercraft of claim 1, further including a flange plate secured to said triangular hatch flap and disposed to overlap said cut line when said hatch flap is in the closed disposition.

3. The improved collapsible watercraft of claim 1, further including adjustable length strap assemblies extending across said cut line and including first portions joined to said hatch flap and second portions joined to said deck panel adjacent to said cut line to releasably secure said hatch flap in the closed disposition with said flange plate impinging on said deck panel and overlapping said cut line.

4. The improved collapsible watercraft of claim 1, wherein said sheet further includes a pair of bow edges extending at opposed sides of a bow end of the deck panel and tapering toward the bow end, said pair of bow edges being brought into close proximity to form a bow deck assembly of said kayak configuration;

a bow deck flap hingedly secured to one of said bow edges at one of said opposed sides and dimensioned and configured to overlap the other of said opposed sides of said bow edges and form a closure therewith when formed into said bow deck assembly; and at least one strap fastener assembly extending between said opposed bow edges in releasable, length-adjustable fashion to secure said bow deck flap in overlapping impingement to said other side and join and secure said bow deck assembly.

5. The improved collapsible watercraft of claim 1, further comprising:

a pair of gunwale assemblies extending longitudinally between bow and stern portions of the kayak assembly, each gunwale assembly comprising a hollow tubular beam extending along a respective side of the kayak configuration; and a floorboard shaped to be complementary to an underlying cockpit area of the kayak configuration, the floorboard including laterally opposed, longitudinally extending side edges and longitudinal fold lines;

wherein the floorboard is bowed upwardly and flexed along the longitudinal fold lines when unloaded, and flattened when loaded by a kayaker's weight, thereby causing the side edges of the floorboard to be driven outwardly and an inner portion of each gunwale assembly to be driven against an outer side panel of the kayak configuration to provide rigidity and strength to the gunwale assemblies.

6. The improved collapsible watercraft of claim 5, wherein each of said gunwale assemblies includes a side panel defined by said fold lines in a midship portion of said sheet, a first gunwale flap hingedly secured to said side panel in integral fashion along a first gunwale fold line, and a second gunwale flap hingedly secured to said first gunwale flap in integral fashion along a second gunwale fold line.

7. The improved collapsible watercraft of claim 6, wherein said first and second gunwale flaps are foldable along said gunwale fold lines to form a triangular tubular relationship with said side panel and define said hollow tubular beam.

8. In a collapsible watercraft formed of a stiff sheet that is creased and foldable along fold lines that define the keel, hull, sides and deck of a kayak configuration, with opposed side edges of the sheet that are folded inwardly each toward the other about a longitudinal axis and brought together to form the kayak configuration, the improvement comprising:

a deck panel formed by said sheet; and a deck hatch formed in said deck panel and movable between a closed disposition and an open disposition that enables access through the deck hatch to a below-deck storage space;

wherein said deck hatch includes a cut line extending in said deck panel and a hatch fold line extending from the terminus of said cut line to define a triangular hatch flap hingedly secured at said hatch fold line and rotatable between said open and closed dispositions.

9. The improved collapsible watercraft of claim 8, further including a flange plate secured to said triangular hatch flap and disposed to overlap said cut line when said hatch flap is in the closed disposition.

10. The improved collapsible watercraft of claim 8, further including adjustable length strap assemblies extending across said cut line and including first portions joined to said hatch flap and second portions joined to said deck panel adjacent to said cut line to releasably secure said hatch flap in the closed disposition with said flange plate impinging on said deck panel and overlapping said cut line.

11. The improved collapsible watercraft of claim 8, said sheet including a pair of bow edges extending at opposed sides of a bow end of the deck panel and tapering toward the bow end, said pair of bow edges being brought into close proximity to form a bow deck assembly of said kayak configuration;

a bow deck flap hingedly secured to one of said bow edges at one of said opposed sides and dimensioned and configured to overlap the other of said opposed sides of said bow edges and form a closure therewith when formed into said bow deck assembly; and at least one strap fastener assembly extending between said opposed bow edges in releasable, length-adjustable fashion to secure said bow deck flap in overlapping impingement to said other side and join and secure said bow deck assembly.

12. The improved collapsible watercraft of claim 8, further comprising:

a pair of gunwale assemblies extending longitudinally between bow and stern portions of the kayak assembly, each gunwale assembly comprising a hollow tubular beam extending along a respective side of the kayak configuration; and a floorboard shaped to be complementary to an underlying cockpit area of the kayak configuration, the floorboard including laterally opposed, longitudinally extending side edges and longitudinal fold lines;

wherein the floorboard is bowed upwardly and flexed along the longitudinal fold lines when unloaded, and flattened when loaded by a kayaker's weight, thereby causing the side edges of the floorboard to be driven outwardly and an inner portion of each gunwale assembly to be driven against an outer side panel of the kayak configuration to provide rigidity and strength to the gunwale assemblies.

13. The improved collapsible watercraft of claim 12, wherein each of said gunwale assemblies includes a side panel defined by said fold lines in a midship portion of said sheet, a first gunwale flap hingedly secured to said side panel in integral fashion along a first gunwale fold line, and a second gunwale flap hingedly secured to said first gunwale flap in integral fashion along a second gunwale fold line.

14. The improved collapsible watercraft of claim 13, wherein said first and second gunwale flaps are foldable along said gunwale fold lines to form a triangular tubular relationship with said side panel and define said hollow tubular beam.

15. In a collapsible watercraft formed of a stiff sheet that is creased and foldable along fold lines that define the keel, hull, sides and deck of a kayak configuration, with opposed side edges of the sheet that are folded inwardly each toward the other about a longitudinal axis and brought together to form the kayak configuration, the improvement comprising:

a deck panel defined by said fold lines and having a free edge; and a deck hatch formed in said deck panel and movable between a closed disposition and an open disposition that enables access through the deck hatch to a below-deck storage space;

wherein said deck hatch includes a triangular hatch flap secured at a hatch fold line and rotatable between said open and closed dispositions, wherein said sheet further includes a pair of bow edges extending at opposed sides of a bow end of the deck panel and tapering toward the bow end, said pair of bow edges being brought into close proximity to form a bow deck assembly of said kayak configuration; and further comprising:

a bow deck flap hingedly secured to one of said bow edges at one of said opposed sides and dimensioned and configured to overlap the other of said opposed sides of said bow edges and form a closure therewith when formed into said bow deck assembly; and at least one strap fastener assembly extending between said opposed bow edges in releasable, length-adjustable fashion to secure said bow deck flap in overlapping impingement to said other side and join and secure said bow deck assembly.

16. In a collapsible watercraft formed of a stiff sheet that is creased and foldable along fold lines that define the keel, hull, sides and deck of a kayak configuration, with opposed side edges of the sheet that are folded inwardly each toward the other about a longitudinal axis and brought together to form the kayak configuration, the improvement comprising:

a deck panel defined by said fold lines and having a free edge; and a deck hatch formed in said deck panel and movable between a closed disposition and an open disposition that enables access through the deck hatch to a below-deck storage space;

wherein said deck hatch includes a triangular hatch flap secured at a hatch fold line and rotatable between said open and closed dispositions, further comprising:

a pair of gunwale assemblies extending longitudinally between bow and stern portions of the kayak assembly, each gunwale assembly comprising a hollow tubular beam extending along a respective side of the kayak configuration; and a floorboard shaped to be complementary to an underlying cockpit area of the kayak configuration, the floorboard including laterally opposed, longitudinally extending side edges and longitudinal fold lines;

wherein the floorboard is bowed upwardly and flexed along the longitudinal fold lines when unloaded, and flattened when loaded by a kayaker's weight, thereby causing the side edges of the floorboard to be driven outwardly and an inner portion of each gunwale assembly to be driven against an outer side panel of the kayak configuration to provide rigidity and strength to the gunwale assemblies.

17. The improved collapsible watercraft of claim 16, wherein each of said gunwale assemblies includes a side panel defined by said fold lines in a midship portion of said sheet, a first gunwale flap hingedly secured to said side panel in integral fashion along a first gunwale fold line, and a second gunwale flap hingedly secured to said first gunwale flap in integral fashion along a second gunwale fold line.

18. The improved collapsible watercraft of claim 17, wherein said first and second gunwale flaps are foldable along said gunwale fold lines to form a triangular tubular relationship with said side panel and define said hollow tubular beam.

* * * * *